US005794779A

United States Patent [19]

Weinheimer et al.

[11] Patent Number: 5,794,779

[45] Date of Patent: Aug. 18, 1998

[54] MULTIFUNCTIONAL CONTAINER

[75] Inventors: Alois Weinheimer, Alzey; Dieter Uhlmann, Wiesbaden, both of Germany

[73] Assignee: Kalle Nalo GmbH, Weisbaden, Germany

[21] Appl. No.: 820,651

[22] Filed: Mar. 18, 1997

[30] Foreign Application Priority Data

Apr. 1, 1996 [DE] Germany ..... 196 13 068.9

[51] Int. Cl.[6] ..... B65D 85/20

[52] U.S. Cl. ..... 206/443; 206/802

[58] Field of Search ..... 452/30, 32; 53/444, 53/484, 485; 206/443, 525, 802; 220/401, 1.5

[56] References Cited

U.S. PATENT DOCUMENTS 5,382,190 1/1995 Graves ..... 206/802 X 5,467,884 11/1995 Schutz ..... 220/401 X

*Primary Examiner*—Jacob K. Ackun

*Attorney, Agent, or Firm*—Foley & Lardner

[57] ABSTRACT

A multifunctional container capable of being used for packaging, transporting and/or soaking folded casings, said containing comprising two transverse walls, at least one of which is provided with an outlet and an outlet cover; two longitudinal side walls; a bottom connected to said longitudinal side walls and said transverse side walls, said transverse walls, longitudinal walls and bottom forming an open cavity therewithin; corner posts located at juncture positions of said transverse and said longitudinal side walls; at least two middle posts positioned vertically on said longitudinal side walls; at least one longitudinal brace which joins said two of said corner posts at a lower portion thereof; and a removable cover which is provided with an inlet and an inlet closure.

15 Claims, 3 Drawing Sheets

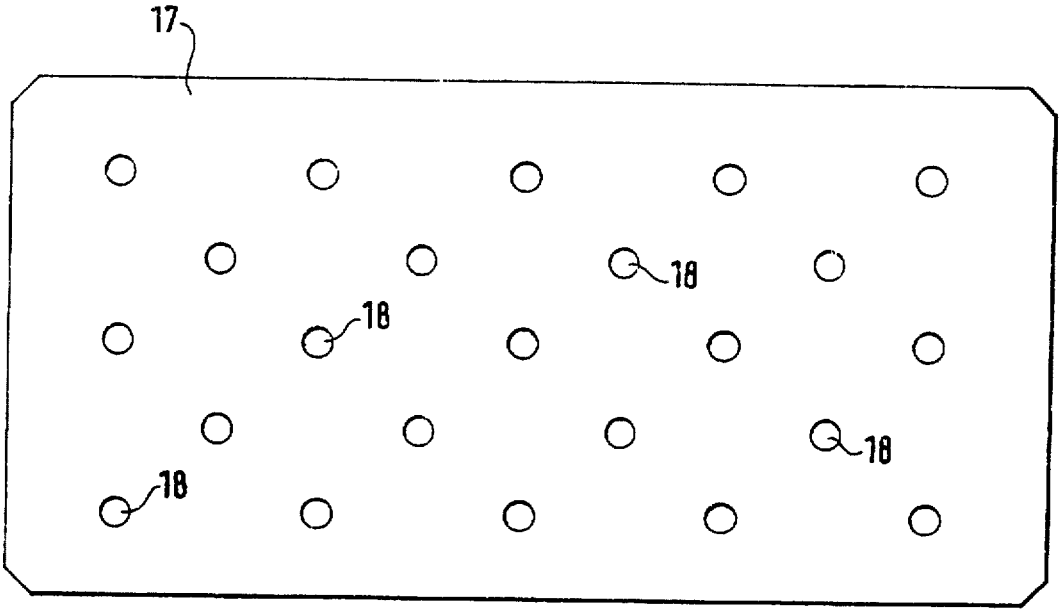
FIG. 3
FIG. 4
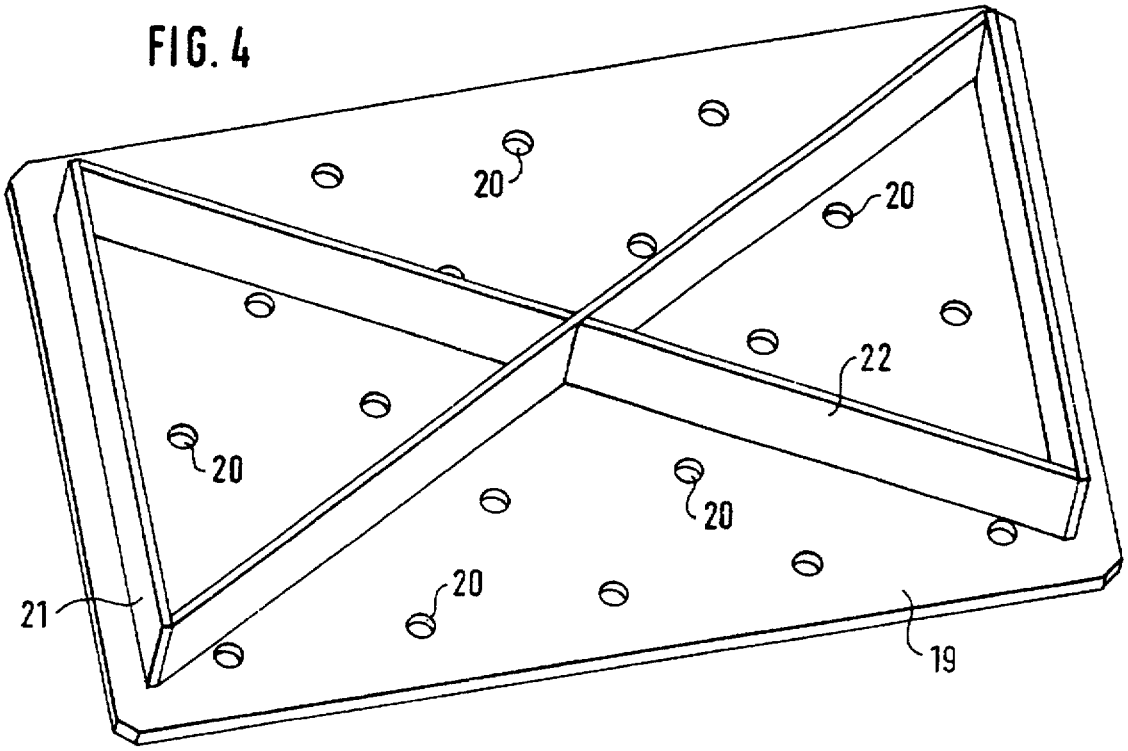

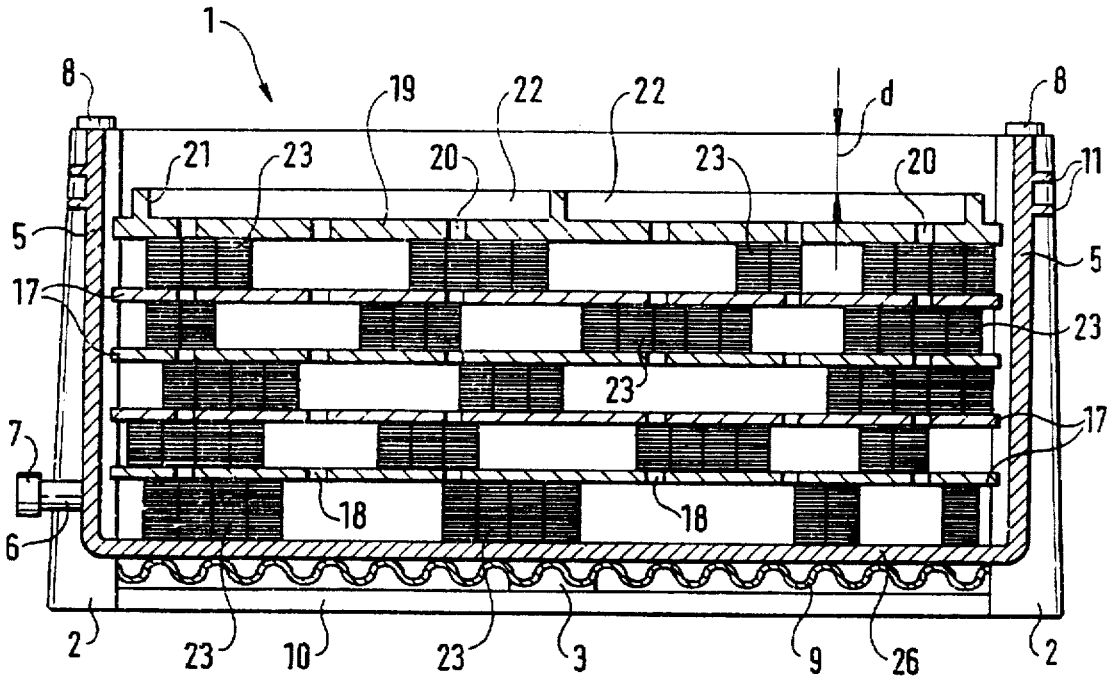
FIG. 5
FIG. 6
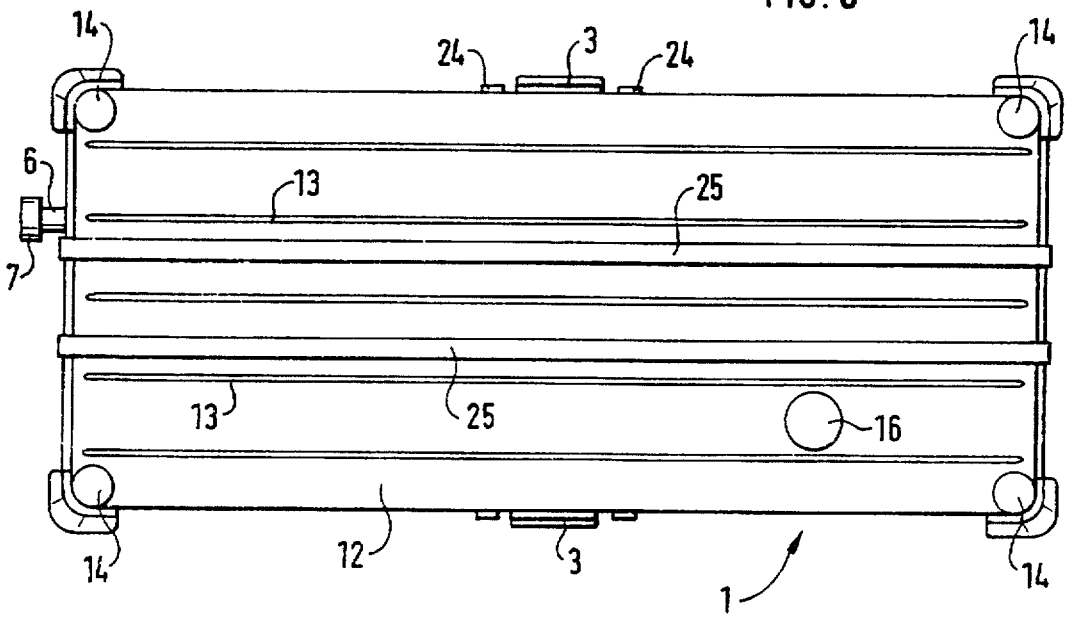

MULTIFUNCTIONAL CONTAINER

BACKGROUND OF THE INVENTION

1. Field of the Invention

The present invention relates to a multifunctional container capable of being used for packaging, transporting and/or soaking folded casings (e.g., shirred sausage casings) for packaging products which are to be filled individually. The container which is designed to be closed by a removable cover, is generally formed by transverse and longitudinal side walls and includes a bottom. The container has corner posts and middle posts as stays which are mutually joined by longitudinal braces.

2. Description of Related Art

Containers such as those described above are generally known as volume containers and have dimensions in accordance with a European standard set for such containers used for packaging and transport of products.

Such products which are transported in containers of this type include shirred casings which are used as packaging for foodstuffs or even non-foodstuffs. Shirred casings are often previously assembled to form so-called "sticks" prior to use. Typically, the casings are packaged at a place of manufacture into cardboard boxes for transport to a processor. These cardboard boxes are typically combined either individually or as a plurality by shrink films to form transport units. In this case, a problem arises that, due to the packaging, both the cardboard boxes and the shrink films must be disposed of as waste by the processor, which involves time, creates space problems and creates extra costs. The unpacked casings must also still be soaked in water at the processor before filling, so that they can be applied to a filling mandrel of a filling machine without difficulty. This means that the unpacked casings must be introduced into a soaking container, thus requiring a further working step at the processor.

SUMMARY OF THE INVENTION

It is thus an object of the present invention to provide a container of the type described at the outset that fulfills a number of functions successively and, furthermore, requires no packaging material which must be disposed of. It is further an object to provide a method for using such a container to package folded casings.

In accordance with these and other objects, according to one aspect of the invention there is provided a multifunctional container capable of being used for packaging, transporting and/or soaking folded casings, the containing comprising: two transverse walls, at least one of which is provided with an outlet and an outlet cover; two longitudinal side walls; a bottom connected to the longitudinal side walls and the transverse side walls, whereby the transverse walls, longitudinal walls and bottom form an open cavity therewithin; corner posts located at juncture positions of the transverse and longitudinal side walls;

at least two middle posts positioned vertically on the longitudinal side walls; at least one longitudinal brace which joins the two corner posts at a lower portion thereof; and a removable cover which is provided with an inlet and an inlet closure.

In accordance with a further aspect of the invention, there is also provided a method for packaging folded casings comprising: inserting at least one layer of folded casings in a container, the container being provided with a removable cover having an inlet included therein; inserting at least one perforated insertion plate to mutually separate each of the layers within the container; attaching at least one transverse tape and at least one longitudinal tape, each of which encircles the container which contains the layer(s) of folded casings; and attaching the cover to the container.

Additional objects, features and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWING

The accompanying drawings, which are incorporated in and constitute a part of the specification, illustrate a presently preferred embodiment of the invention, and, together with the general description given above and the detailed description of the preferred embodiments given below, serve to explain the principles of the invention.

FIG. 3 shows a plan view of a perforated insertion plate which mutually separates two superposed stacked layers of folded casings within the container;

FIG. 4 shows a perspective plan view of a perforated closing plate, reinforced with ribs, as the topmost plate of the superposed stacked layers of folded casings within the container;

FIG. 5 shows a longitudinal section along the line A—A in FIG. 1 through a container filled with folded casings and prepared for transport, with the cover taken off; and FIG. 6 shows a plan view of the container closed by a cover and packaged with transverse and longitudinal tapes.

DETAILED DESCRIPTION OF THE PREFERRED EMBODIMENTS

According to the present invention, the above objects are achieved, inter alia, by providing a cover with an inlet which is closed by an inlet closure, and by producing an outlet with an outlet closure fitted in one of the transverse side walls. According to one embodiment, the folded casings are preferably stacked upright in a plurality of layers in the container, and the individual layers are preferably mutually separated by insertion plates. Expediently, the topmost layer of the stacked folded casings is then covered by a closing plate which has holes and is reinforced by transverse and diagonal ribs.

Further, the bottom preferably includes a bottom underside with corrugated ribs which extend transversely to the longitudinal extent of the container. It is therefore possible to include transverse tapes extending in depressions formed between two ribs and underneath the cover so as to enclose the container on both sides of a middle post.

Figure 1:
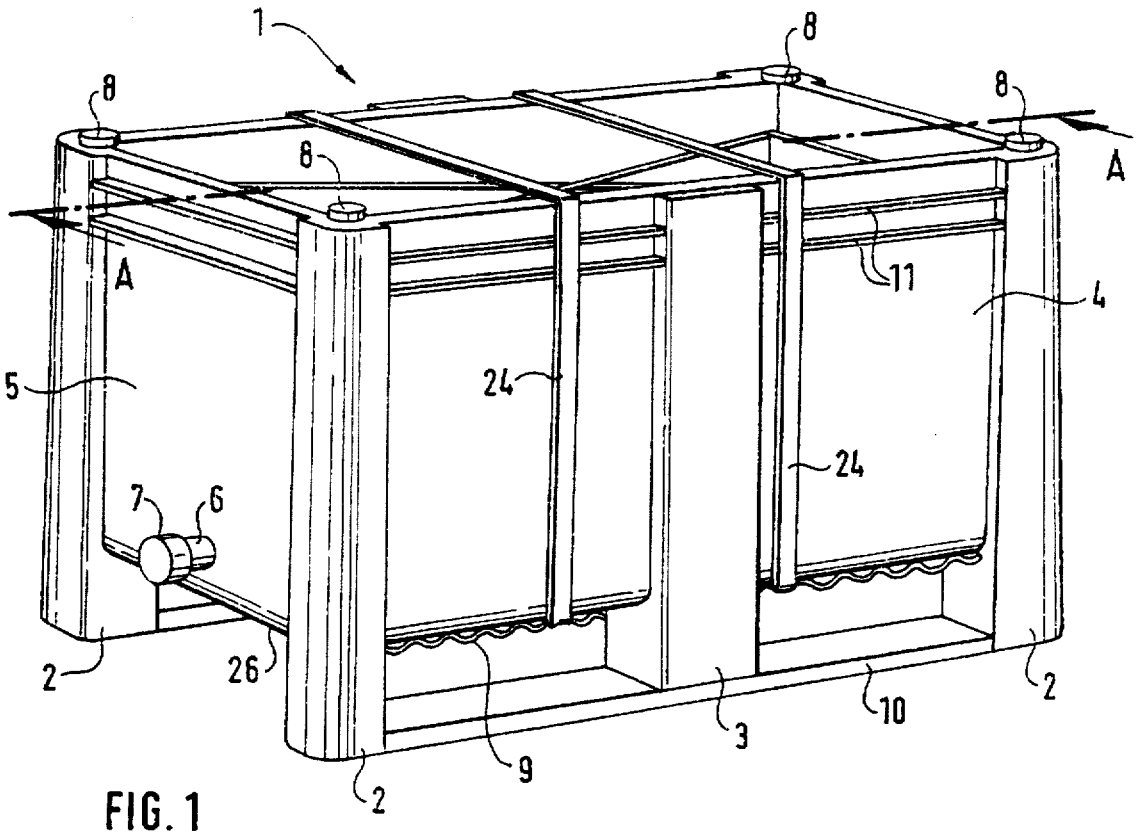
FIG. 1 shows a perspective view of a multifunctional container, with the cover taken off and packaged with transverse tapes.
Figure 2:
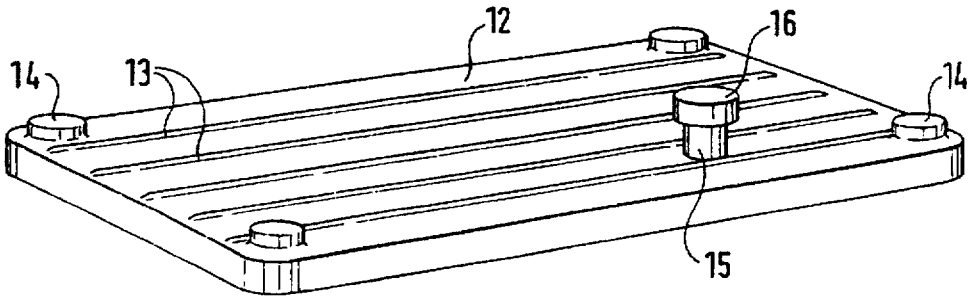
FIG. 2 shows a perspective view of the cover of the container according to FIG. 1.

The invention is explained in more detail below by reference to an exemplary embodiment illustrated by drawings. A container 1 shown perspectively in FIG. 1 comprises longitudinal side walls 4 and transverse side walls 5 as well as a bottom 26 which preferably has a corrugated bottom underside 9. The top of the container 1 is closed by a cover 12 as shown in FIG. 2. In FIG. 1, the cover is taken off. The container 1 preferably has four corner posts 2 and two middle posts 3 on the longitudinal side walls 4. The corner posts and middle posts 2, 3 form so-called stays which are mutually joined by at least one longitudinal brace 10. The rigidity and stability of the container 1 are increased by employing two longitudinal braces 10. The corner posts 2 and the middle posts 3 are preferably of reinforced design and protrude beyond the lower extent of the longitudinal and transverse side walls 4, 5. The upper region of the longitudinal and transverse side walls 4, 5, is reinforced by container ribs 11 which loop the container 1 between the corner posts 2 and the middle posts 3. The bottom 26 or the bottom underside 9 preferably has sufficient bottom clearance so as to permit the fork of an underfloor vehicle to be introduced without problems underneath the bottom underside, in order to pick up the container 1 and to transport it.

In one transverse side wall 5 of the container 1, there is expediently provided an outlet 6 which has an outlet closure 7. The outlet closure 7 is, preferably screwed onto a thread of the outlet 6. As can be seen from FIG. 1, the outlet 6 is preferably located as close as possible to the bottom 26 of the container 1. The bottom underside 9 is preferably provided with corrugated ribs which extend transversely to the longitudinal extent of the container 1. On both sides of the middle posts 3, transverse tapes 24 may be fitted which enclose the container 1 over its entire periphery. These transverse tapes run on the bottom underside 9 in the depressions formed between two ribs and on the top of the container 1 underneath the cover, i.e., the cover rests on the transverse tapes 24.

FIG. 2 perspectively shows the cover 12 which is reinforced by cover ribs 13 in the longitudinal direction of the cover 12. At the four corners of the cover 12, there are preferably included knob recipients 14 which may be curved upwardly. The knob recipients 14 are designed such that they rest on the knobs 8 of the corner posts 2 of the container 1 when the latter is closed by the cover. The inlet 15 is located close to one transverse edge of the cover. The inlet 15 is closed by the inlet closure 16, which can be, for example, a turning closure. Of course, the inlet 15 can also be fitted at a location on the cover 12 other than that shown.

FIG. 3 shows a plan view of an insertion plate 17 which includes holes 18 in a plurality of rows, the holes of adjacent rows being mutually offset. In the container 1, there are in general a plurality of insertion plates 17, the individual insertion plate 17 mutually separating adjacent superposed layers of the product to be stacked. The holes 18 ensure that, when the stacked products are soaked, water can flow unhindered from one layer of stacked product to the next lower layer of stacked product.

FIG. 4 shows a perspective plan view of a closing plate 19 which preferably covers the topmost layer of the stacked product. The closing plate 19 is provided with holes 20 and is reinforced by diagonal ribs 22 and transverse ribs 21. The reinforcement of the closing plate 19 by the transverse ribs 21 and diagonal ribs 22 is particularly preferable, since the closing plate 19 should be able to absorb large buoyancy forces when the container 1 is filled with water. Further, under some circumstances, the closing plate 19 will tend to float up to such an extent that it is forced against the underside of the cover 12. In this case, if the closing plate 19 is not reinforced, deformations and even destruction can very easily occur. A further point is that due to inclusion of its transverse and longitudinal ribs, the closing plate 19 will generally possess a substantially greater weight than the insertion plates 17 and can thereby correspondingly put weight on superposed layers of the stacked product in order to counteract large buoyancy. The large buoyancy, inter alia, is intensified by the inclusion of air in the stacked product and by the expansion of the stacked product when it is wetted. Above all, the increased buoyancy of the stacked product is typically caused by the fact that the specific gravity of the stacked product is somewhat lower than the specific gravity of water.

FIG. 5 shows a longitudinal section through a container 1 which is filled with folded casings 23 in the shape of sticks for transporting or shipping to a processor. The folded casings 23 are, for example, sausage casings which must be soaked before they are filled with sausage meat. The casings are soaked so that they are supple and extensible and can therefore be slipped over a stuffing horn of a filling machine without problems. For example, the container 1 shown preferably takes in five layers of folded casings 23, the first layer sitting directly on the inside of the bottom 26 of the container 1. The individual layers of folded casings 23 are preferably close to each other in proximity, i.e., the folded casings are located tightly next to one another. In the drawing, gaps have been left in the individual layers for reasons of improved clarity; however in practice, the individual layer preferably comprise mutually adjoining folded casings 23 throughout. Between the individual layers of the folded casings 23, there are preferably included insertion plates 17, described above, with holes 18. The insertion plates 17 preferably have some play relative to the transverse side walls 5 and the longitudinal side walls 4. That is, their edges preferably do not bear against these walls. The topmost layer of the stacked folded casings 23 is preferably covered by a closing plate 19 which has holes 20 and is at a distance (d) from the top edge of the container 1 or, if the latter is closed by a cover 12, from the underside of the cover 12. This distance (d) is preferably of the order of magnitude of the length of the upright folded casings 23 and serves to compensate for any buoyancy generated by soaking the folded casings 23 in water. As already explained above, inter alia, the buoyancy results from the lower specific gravity of the material of the folded casings, as compared with water, and from the expansion of the soaked folded casings which can increase their length by up to about 1.5% greater than their length prior to being soaked in water.

A container 1 in which five layers of folded casings are stacked which are each separated from one another by insertion plates 17, and a topmost layer being covered by the closing plate 19, has, according to the European standard, external dimensions of L×W×H=1200 mm×800 mm×740 mm. When this container 1 is filled with water up to the height of the closing plate 19 for soaking the folded casings 23, its total weight is about $9.81\times10^3$ N (approximately 1 tonne).

The plan view in FIG. 6 of a container 1 closed by the cover 12 shows that two longitudinal tapes 25 which are passed above the cover 12 enclose the container 1 between the cover ribs 13. To the left and right of the middle posts 3, transverse tapes 24 are arranged which run between the upper edge of the container 1 and the cover 12 and likewise enclose the container 1.

For shipping, the container 1 is preferably filled by the manufacturer of the folded casings with the dry folded casings 23, the insertion plates 17 and the closing plate 19. The container 1 thus serves both as a packaging container and as a transport container. For the transport of the open container 1, the transverse tapes 24 are first fitted on either side of the middle posts 3, the container is then closed by the cover 12 and longitudinal tapes 25 are laid upon the outside of the cover 12 and taken around the container 1 and tightened. During this, the outlet 6 and the inlet 15 are generally closed.

As soon as the container has arrived at the further processor of the folded casings, for example, a butchery or sausage establishment, the folded casings can be soaked in water at any time as required. The soaking is generally carried out for a period of at least 30 to 40 minutes and at water temperatures of up to 50° C. During the soaking in water, the container 1 remains closed and enclosed by the longitudinal and transverse tapes, and water is introduced into the container 1 via the opened inlet 15. As soon as the folded casings 23 have been soaked for a sufficient time, the longitudinal tapes 25 and the cover 12 are taken off, so that the folded casings 23 can be taken out. The water can flow out partially or entirely via the opened outlet 6 even before the container 1 is opened, but this can also happen at a later time. The emptied container 1 can be re-used and/or can be sent back to the manufacturer of the folded casings.

As a result of the multiple function of the container 1 as a packaging, transport and soaking container, much time is saved, since there is no packaging of the folded casings for shipping. In addition, there is no requirement of unpacking or insertion into a separate soaking container. A further advantage is that the disposal of packaging waste is very largely avoided.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

The Priority Document, German Application 196 13 068.9, filed Apr. 1, 1996 is hereby incorporated by reference in its entirety including the title, specification, abstract, drawings, and claims.

What is claimed is:

1. A multifunctional container capable of being used for packaging, transporting and/or soaking folded casings, said container comprising:

two transverse walls, at least one of which is provided with an outlet and an outlet cover;

two longitudinal side walls;

a bottom connected to said longitudinal side walls and said transverse side walls, said transverse walls, longitudinal walls and bottom forming an open cavity therewithin;

corner posts located at juncture positions of said transverse and said longitudinal side walls;

at least two middle posts positioned vertically on said longitudinal side walls;

at least one longitudinal brace which joins said two of said corner posts at a lower portion thereof; and a removable cover which is provided with an inlet and an inlet closure.

2. A container as claimed in claim 1, further comprising at least one perforated insertion plate which is capable of being inserted within the said open cavity, and wherein the folded casings are capable of being stacked upright in a plurality of layers in the container and wherein the individual layers are capable of being mutually separated by said at least one perforated insertion plate.

3. A container as claimed in claim 2, further comprising a closing plate provided with holes and which is reinforced by transverse and diagonal ribs, said closing plate being capable of being inserted within said open cavity, said closing plate further being capable of being provided above a topmost layer of the stacked folded casings.

4. A container as claimed in claim 1, wherein the bottom includes an underside with a plurality of corrugated ribs which extend transversely to a longitudinal extent of the container, and wherein said container is encircled by at least one transverse tape which extends in depressions formed between two of said corrugated ribs and underneath the cover.

5. A container as claimed in claim 1, wherein the corner posts and the middle posts are reinforced and protrude beyond the longitudinal and transverse side walls and the bottom of said container, and wherein the bottom underside has sufficient bottom clearance so as to permit the container to be picked up by the fork of an underfloor vehicle.

6. A container as claimed in claim 1, further comprising knobs provided at upper ends of said corner posts, and corresponding knob recipients on said cover, said knob recipients being adapted to rest upon said knobs.

7. A container as claimed in claim 1, further comprising at least one longitudinal tape encircling the container across said cover, said transverse side walls, and said bottom, thereby maintaining said cover in place.

8. A container as claimed in claim 1, further comprising container ribs reinforcing the longitudinal and transverse side walls.

9. A container as claimed in claim 1, wherein the cover is reinforced by cover ribs extending in the longitudinal direction.

10. A container as claimed in claim 3, wherein the closing plate maintains a distance (d) from the cover, said distance (d) being related to a length of folded casings assembled to form a concertina.

11. A method for packaging folded casings comprising:

inserting at least one layer of folded casings in a container, said container being provided with a removable cover having an inlet included therein;

inserting at least one perforated insertion plate to mutually separate each of said layers within said container;

attaching at least one transverse tape which encircles said container which contains said at least one layer of folded casings;

attaching said cover to said container; and attaching at least one longitudinal tape which encircles said container.

12. A method according to claim 11, comprising the addition step of inserting a perforated closing plate, reinforced with ribs, as the topmost plate of said folded casings within said container.

13. A method according to claim 11, further comprising inserting water in said container through said inlet; and soaking said casings in said water.

14. A method according to claim 13, wherein said soaking is conducted for a period of at least 30 minutes and at water temperatures of up to 50° C.

15. A method for packaging folded casings comprising:

providing a container according to claim 1;

inserting at least one layer of said folded casings in said container.

* * * * *